US008992696B2

(12) United States Patent
Walker et al.

(10) Patent No.: US 8,992,696 B2
(45) **Date of Patent: *Mar. 31, 2015**

(54) METHOD OF BONDING A METAL TO A SUBSTRATE

(75) Inventors: Michael J. Walker, Shelby Township, MI (US); Bob R. Powell, Jr., Birmingham, MI (US); Aihua A. Luo, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 533 days.

This patent is subject to a terminal disclaimer.

(21) Appl. No.: 13/310,042

(22) Filed: Dec. 2, 2011

(65) Prior Publication Data

US 2012/0301669 A1 Nov. 29, 2012

Related U.S. Application Data

(60) Provisional application No. 61/488,958, filed on May 23, 2011.

(51) Int. Cl.

| | |
|---|---|
| ***C23C 22/70*** | (2006.01) |
| ***C23C 22/56*** | (2006.01) |
| ***B22D 19/04*** | (2006.01) |
| *C25D 11/04* | (2006.01) |

(52) U.S. Cl.

CPC ..... *B22D 19/04* (2013.01); *Y10T 428/24355* (2013.01)

USPC ..... 148/285; 148/242; 148/276; 148/277; 148/284; 205/324; 205/333; 427/383.1

(58) Field of Classification Search

USPC ..... 148/242, 276, 277, 284, 285; 205/324, 205/333; 427/383.1

See application file for complete search history.

(56) References Cited

U.S. PATENT DOCUMENTS

| | | | | |
|---|---|---|---|---|
| 3,069,209 | A | 12/1962 | Bauer | |
| 3,935,349 | A | 1/1976 | Terai et al. | |
| 4,127,451 | A | 11/1978 | Marceau et al. | |
| 5,131,987 | A | 7/1992 | Nitowski et al. | |
| 5,324,587 | A | 6/1994 | Nitowski et al. | |
| 5,486,283 | A | 1/1996 | Mnich | |
| 5,774,336 | A | 6/1998 | Larson | |
| 6,450,396 | B1 | 9/2002 | Krajewski | |
| 6,531,013 | B2 | 3/2003 | Nitowski | |
| 6,852,266 | B2 | 2/2005 | Robinson et al. | |
| 6,887,321 | B2 | 5/2005 | Parkos, Jr. et al. | |
| 2013/0037177 | A1 * | 2/2013 | Chiang et al. | 148/403 |

FOREIGN PATENT DOCUMENTS

| | | |
|---|---|---|
| DE | 2729391 | 12/1977 |
| DE | 19606689 | 8/1996 |
| EP | 0242208 | 7/1991 |
| WO | WO 2006/119554 | 11/2006 |

* cited by examiner

*Primary Examiner* — Lois Zheng

(74) *Attorney, Agent, or Firm* — Dierker & Associates, P.C.

(57) ABSTRACT

A method of bonding a metal to a substrate involves forming a plurality of nano-features in a surface of the substrate, where each nano-feature is chosen from a nano-pore and/or a nano-crevice. In a molten state, the metal is over-cast onto the substrate surface, and penetrates the nano-features. Upon cooling, the metal is solidified inside the nano-features, where the solidification of the metal forms a mechanical interlock between the over-cast metal and the substrate.

13 Claims, 3 Drawing Sheets

Fig-1D-A

METHOD OF BONDING A METAL TO A SUBSTRATE

CROSS REFERENCE TO RELATED APPLICATION

This application claims the benefit of U.S. Provisional Patent Application Ser. No. 61/488,958 filed May 23, 2011.

TECHNICAL FIELD

The present disclosure relates generally to methods of bonding a metal to a substrate.

BACKGROUND

Many automotive parts are fabricated from, for example, aluminum or steel. In some instances, it may be desirable to replace at least a portion of the aluminum or steel part with a lighter-weight material, such as magnesium. The presence of the lighter-weight material may, in some cases, reduce the overall weight of the automotive part.

SUMMARY

A method of bonding a metal to a substrate is disclosed herein. The method involves forming a plurality of nano-features in a surface of the substrate, where each nano-feature is chosen from a nano-pore and/or a nano-crevice. In a molten state, the metal is over-cast onto the substrate surface and penetrates the plurality of nano-features. Upon cooling, the metal is solidified inside the plurality of nano-features, where the solidification of the metal forms a mechanical interlock between the over-cast metal and the substrate.

BRIEF DESCRIPTION OF THE DRAWINGS

Features and advantages of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

FIG. 1D-A is an enlarged view of a portion of the schematic shown in FIG. 1D;

DETAILED DESCRIPTION

Figures 1A, 1B, 1C:
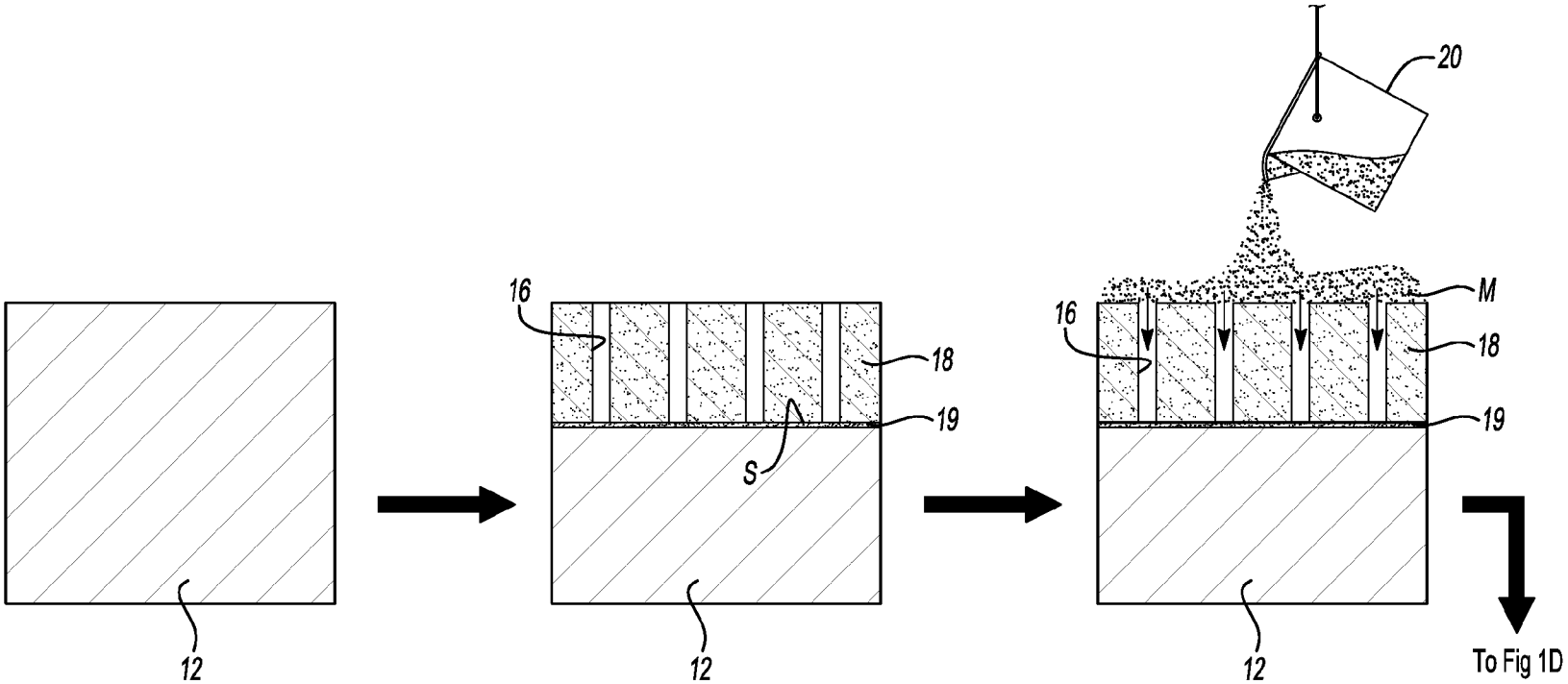
FIGS. 1A through 1D schematically depict an example of a method of bonding a metal to a substrate.

Aluminum and steel may be used to make various automotive parts, at least because these materials have a mechanical strength that contributes to the structural integrity of the part. It has been found that some of the aluminum or steel in a part may be replaced by lighter-weight material(s) (such as, e.g., magnesium). It is believed that the presence of the magnesium may, in some instances, reduce the overall weight of the automotive part.

It has been found that magnesium may be incorporated onto an aluminum or steel part via a casting process, such as a process known as over-casting. It has also been found that, in some instances, the magnesium may not metallurgically bond to the underlying aluminum or steel, at least not to the extent necessary to form a part that is considered to be structurally sound and usable in an automobile. For example, the aluminum may include a dense oxide surface layer (e.g., alumina) formed thereon, which, during casting, may prevent magnesium from metallurgically bonding to the aluminum underneath the oxide layer or directly to the oxide layer. More specifically, during the casting process, magnesium cannot penetrate the dense oxide layer and bond with the underlying aluminum in a manner sufficient to render the resulting part as structurally sound. As used herein, a part that is "structurally sound" is one that has mechanical properties that enable the part to withstand various operating stresses and strains incurred during use of the part.

Example(s) of the method disclosed herein may be used to form a part by bonding a metal (such as magnesium or magnesium alloys) to a substrate (such as aluminum, titanium, steel, etc.), and the joint created between these materials is such that the part is considered to have the structural integrity necessary so that the part can be used in an automobile. In an example, the two materials may be joined together by improving the joint strength at an interface (i.e., its interfacial strength) between the metal and the substrate. This may be accomplished by manipulating the surface of the substrate so that the metal, in the molten state, can penetrate pores, crevices, cavities, or the like formed into the surface, and mechanically bond to the surface. In an example, the mechanical bond is a mechanical interlock created by the metal penetrating the manipulated surface of the substrate. In some cases, a chemical bond may also form, such as a metallurgical bond between the metal and the surface.

An example of the method of mechanically bonding a metal to a substrate will now be described in conjunction with FIGS. 1A-1D, 2A, and 2B. In this example, the part 10 (shown in FIG. 1D) which is formed by the method includes an aluminum substrate and a magnesium metal bonded thereto. It is to be understood that the method may also or otherwise be used to form parts made from other combinations of materials. For instance, the part may be formed from substrate materials that may suitably be used for automotive applications (e.g., to make an automotive chassis component, an engine cradle, an instrument panel (IP) beam, an engine block, a cylinder head, and/or the like). The substrate may, in some cases, be chosen from materials that are refractory enough so that the material does not melt when exposed to the molten metal during over-casting, details of which will be provided below at least in conjunction with FIG. 1C. The substrate materials may be chosen from a metal, such as aluminum, zinc, magnesium, titanium, copper, and alloys thereof. It is to be understood that other substrate materials may also be used as appropriate with respect to the method disclosed herein, some examples of which include cast iron, superalloys (e.g., those based on nickel, cobalt, or nickel-iron), steel (which is an alloy of iron, carbon, and possibly other components), brass (which is a copper alloy), and non-metals (e.g., high melting temperature polymers, such as those polymers having a melting temperature of at least 350° C., glass, ceramics, and/or the like). The substrate material may otherwise be chosen from a material to make a part that is suitable for use in other applications, such as non-automotive applications including aircraft, tools, housing/building components (e.g., pipes, etc.), or the like. In these applications, the substrate material may be chosen from any of the metals listed above, or may be chosen from another metal or non-metal (e.g., steel, cast iron, ceramics, high melting temperature polymers (such as, e.g., crystal polymers, polyimides, polyether imides, polysulfones, and/or other polymers having a melting temperature of at least 350° C.), etc.). The high melting temperature polymers may further include a protective layer and/or be cooled to prevent the polymer from melting and/or decomposing so that the combination of the polymer, protective layer, and the over-casting process does not significantly damage the substrate (i.e., the article formed by the substrate/over-cast metal system is still functional for its intended purpose).

If the substrate is chosen from a metal other than aluminum, the substrate material may, in an example, be aluminized (i.e., the formation of an aluminum or aluminum-rich alloy layer on the surface of the substrate material) to be used in the method disclosed herein. For instance, steel may be aluminized via hot-dipping the steel in an aluminum-silicon melt, which forms an aluminum layer on the steel surface. This aluminum layer may later be anodized to form alumina, as described in detail below. It is believed that other materials, e.g., titanium, copper, etc. may also be aluminized via hot-dipping or another suitable method such as, e.g., vapor deposition.

It is to be understood that an aluminum surface is not required to perform examples of the method disclosed herein. For instance, magnesium, titanium, or another metal may be oxidized to form an oxide layer within which nano-pores may be formed, and thus other systems may be used beyond over-casting magnesium onto aluminum or an aluminized surface so long as the surface is or may become porous.

In one example, the metal to be bonded to the substrate may be chosen from any metal on the periodic table of elements that has a melting point or temperature that is lower than, or near (e.g., within 1° C. of) the melting temperature of the substrate to which metal is bonded. It is to be understood that the over-cast metals discussed herein may be the pure metal or an alloy thereof. It has been found that selecting metals having a lower melting point than the substrate enables casting to be accomplished without melting the underlying substrate. For example, magnesium may be selected as a metal to be over-cast on any of the substrate materials chosen from metals such as aluminum, zinc, titanium, copper, nickel, and/or alloys thereof at least in part because the melting temperature of magnesium is about 639° C. and is lower than any of the substrate materials. It is to be understood that, in some instances, magnesium may also be selected as the substrate material, as discussed below. Some examples of combinations of the metal and substrate that may be used to form an automotive part, for instance, include i) magnesium and aluminum, respectively, and ii) magnesium and steel, respectively. Other examples of metals that may be chosen include aluminum, copper, titanium, and alloys thereof. If aluminum is selected as the over-cast metal, the aluminum may be bonded to substrate materials having a melting temperature that is lower than aluminum. For instance, aluminum (which has a melting temperature of about 660° C.) may be bonded to copper (which has a melting temperature of about 1083° C.), titanium (which has a melting temperature of about 1660° C.), or steel (e.g., stainless steel has a melting temperature of about 1510° C. and carbon steel has a melting temperature ranging from about 1425° C. to about 1540° C.). Further, if copper is chosen as the metal, then the copper may be bonded to titanium or steel at least in part because copper has a lower melting temperature than titanium and steel.

It is to be understood that the melting temperature of the over-casting metal does not have to be less than the substrate, at least in part because the substrate selected may include a protective layer, be subjected to cooling, and/or have a mass and conductivity that is sufficient to extract the heat of solidification before melting. For instance, aluminum (again, which has a melting temperature of about 660° C.) may be over-cast on magnesium (which has a melting temperature of about 639° C.) if the over-casting is performed, e.g., in a die caster with a cooling mechanism to cool the magnesium.

As such, it is believed that the over-cast metal may be selected from a metal that has a higher melting temperature than the substrate. In this example, the substrate material may be cooled during the over-casting, and/or have a mass that is sufficient so that the molten over-cast metal solidifies before the metal deleteriously affects the structural integrity of the substrate, and/or have a protective layer thereon. In some instances, the heat transfer to the substrate may be low enough so that the temperature of the substrate does not reach its melting temperature, and thus will not melt (or melts slightly). In some instances, a coating (made from a material that has, e.g., a very high melting temperature (e.g., alumina)) may be established on the substrate that can reduce the heat transfer to the substrate. For example, alumina (which has a melting temperature of about 2072° C.) may be used as a suitable coating for the substrate. It is to be understood, however, that the coating material selected should also be durable and adherent so that the material can contribute to the structural integrity of the formed part.

Accordingly, in an example, when the metal is chosen from magnesium, the substrate may be chosen from aluminum, magnesium, zinc, titanium, copper, steel, and alloys thereof. In one instance, different alloys or compositions of magnesium may be used as the over-cast metal and the substrate material. The magnesium may be pure magnesium, or may be magnesium alloyed with at least one of aluminum, zinc, manganese, or suitable alloy material. For instance, magnesium alloy AM60 (which has a melting temperature of about 615° C.) may be over-cast onto an extruded AZ31B magnesium alloy tube (which has a melting temperature of about 630° C.).

In another example, when the metal is chosen from aluminum, the substrate may also be chosen from aluminum, magnesium, zinc, titanium, copper, steel, and alloys thereof.

While several examples have been given herein, it is to be understood that any combination of substrate and over-cast metal materials may be used so long as the casting procedure (e.g., casting temperatures, times, etc.) is such that over-casting may be accomplished without significantly damaging the substrate.

For purposes of illustration, the instant example of the method will be described in detail below with the substrate material specifically chosen from aluminum or aluminum alloys and the bonding metal being magnesium. While this example involves the formation of pores in an oxide (i.e., aluminum oxide), it is to be understood that the mechanical interlock may be formed when the metal penetrates the pores of any substrate material, not limited to the aluminum oxide discussed in detail in this example.

Referring now to FIGS. 1A-1D, the instant example of the method includes selecting a substrate 12 (shown in FIG. 1A), and then manipulating the surface S of the substrate 12. The surface S may be manipulated by forming a plurality of nano-features 16 in the surface S, as shown in FIG. 1B. In this example of the method, the nano-features 16 are nano-pores.

Further details of the nano-pores 16 will be described below in conjunction with FIGS. 2A and 2B.

In an example, the nano-pores 16 are formed by growing a porous metal oxide structure 18 on the substrate surface S via an anodization process. Briefly, anodization is the oxidation of a portion of the aluminum substrate 12 to form the structure 18 made of aluminum oxide (i.e., alumina). Thus, a portion of the aluminum substrate 12 is consumed as the aluminum oxide structure 18 grows. Anodization may be accomplished, for instance, by employing the aluminum substrate 12 as the anode of an electrolytic cell, and placing the anode and a suitable cathode in an aqueous electrolyte. Some examples of the electrolyte include sulfuric acid ($H_2SO_4$), phosphoric acid ($H_2PO_4$), oxalic acid ($C_2H_2O_4$), and chromic acid ($H_2CrO_4$). These electrolytes desirably form porous alumina; i.e., an alumina structure 18 including the nano-pores 16 formed therein. Further, any suitable cathode may be used, examples of which may include aluminum or lead. A suitable voltage and current (e.g., a DC current or, in some cases, a DC component and an AC component) is applied to the electrolytic cell for an amount of time to anodize a selected portion of the aluminum substrate 12 to grow the structure 18. In an example, about 10 μm to about 250 μm of the aluminum substrate 12 or, in another example, about 10 μm to about 100 μm of the aluminum substrate 12 is anodized depending, at least in part, on the desired thickness of the porous oxide layer/structure 18 to be formed. For instance, it is believed that, for anodizing using a sulfuric acid electrolyte, every 3 μm of the oxide layer that is formed consumes about 2 μm of the underlying substrate 12. It is further believed that the foregoing ratio may change based, at least in part, on the porosity of the anodized layer and the mass balance of the metal oxide layer and the underlying substrate 12. In an example, anodization may occur at a voltage ranging from about 1 V to about 120 V, and the voltage may be adjusted as desired throughout the anodization process as the oxide layer (or structure 18) grows thicker.

It is to be understood that other parameters may be adjusted, in addition to the voltage, to control the thickness of the oxide layer/structure 18. For instance, the thickness of the oxide layer 18 depends, at least in part, on the current density multiplied by the anodization time. Typically, a particular voltage is applied in order to achieve the current density required to grow the oxide layer 18 to a desired thickness. Furthermore, the electrolyte used, as well as the temperature, may also affect the properties of the oxide layer 18, and the ability to grow and form the oxide layer 18 to a desired thickness. For instance, the thickness of the oxide layer 18 may depend on the conductivity of the electrolyte, which in turn depends on the type, concentration, and the temperature of the electrolyte. Further, the oxide layer 18 is electrically insulating, and thus at a constant voltage, the current density will decrease as the layer grows. In some cases, the decrease in current density may limit the maximum growth of the oxide layer 18, and thus the voltage cannot always be continuously increased to increase the thickness of the layer 18. However, in some instances, it may be desirable to increase the voltage throughout the process. In one example, the voltage applied may start at about 25 V to about 30 V, and then the voltage may be ramped up to a higher voltage as the oxide layer 18 grows.

Additionally, the size of the nano-pores 16 may be controlled at least by adjusting the voltage, but the adjustment to the voltage may change depending on the material(s) used (e.g., the electrolyte). In one example, nano-pores 16 have an effective diameter D (shown in FIG. 1D-A) of about 1.29 nm per 1 V of voltage applied, and the spacing between adjacent pores 16 is about 2.5 nm per 1V of voltage applied. The pore 16 size and spacing will be described in further detail below.

It is to be understood that the growth of the structure 18 (i.e., the porous aluminum oxide layer) depends, at least in part, on current density, the chemistry of the electrolytic bath (i.e., the electrolyte), the temperature at which anodization occurs, the amount of anodization time, and/or the voltage applied. In some cases, certain properties of the structure 18 may also be controlled by incorporating AC current in place of or superimposed onto the DC current. Furthermore, anodization may be accomplished at a temperature ranging from about −5° C. to about 70° C., and the process may take place for a few minutes up to a few hours depending, at least in part, on a desired thickness of the structure 18 to be grown. In one example, the thickness of the oxide layer or structure 18 grown ranges from about 2 μm to about 250 μm. In another example, the thickness of the oxide layer or structure 18 grown ranges from about 40 μm to about 80 μm.

The porous oxide structure 18 formed via the anodization process described herein may include many nano-pores 16 defined therein, and a barrier layer 19 of alumina defining the bottom of each pore 16. The barrier layer 19 is a thin, dense layer (i.e., with little porosity, if at all), and may constitute from about 0.1% to about 2% of the entire thickness of the oxide structure 18 formed.

As used herein, the term "nano-pore" refers to a pore having an effective diameter (knowing that each pore may not have a perfectly circular cross section) falling within the nanometer range (e.g., from 1 nm to 1000 nm); and the pore may extend at least partially through the oxide structure 18. In some cases, the oxide structure 18 may be etched to remove portions thereof at the bottom of the nano-pores 16 (including the barrier layer 19), thereby exposing the underlying aluminum substrate 12. In one example, each nano-pore 16 has a substantially cylindrical shape that extends throughout the length of the pore as schematically shown, for example, in FIG. 2A. It is to be understood that the size of the nano-pores 16 depends, at least in part, on the anodization parameters as described above. Further, it is assumed that the effective diameter of each pore 16 is about the same, and that the effective diameter is also substantially the same throughout the length of the pore 16. It is to be understood, however, that each nano-pore 16 may not necessarily have a diameter that is consistent throughout its length; e.g., one or more pores 16 may have a diameter that is smaller at the top of the pore 16 (e.g., the end of the pore opposed to the substrate surface S) and bigger at the bottom of the pore 16 (e.g., the end of the pore adjacent to the substrate surface S).

In an example, the effective diameter D of each nano-pore 16 (shown in FIG. 1D-A) ranges from about 15 nm to about 160 nm. In another example, the effective diameter D of each nano-pore 16 ranges from about 25 nm to about 75 nm. It is to be understood, however, that the desired effective diameter D (or size) of the nano-pores 16 may depend, at least in part, on the fluidity, viscosity, and wettability of the molten metal M, at least in part because the molten metal M will be penetrating the nano-pore 16. Further, the desired size of the nano-pores 16 may also depend on whether or not the substrate surface S is wetting to the metal M (which will be described in further detail below). Generally, in instances where the surface S is wetting to the metal M, the desired size of the nano-pores 16 may be smaller than when the surface S is non-wetting to the metal M.

Further, the diameter of the nano-pores 16 may vary through the height of the oxide structure 18 (e.g., where the nano-pores 16 have segments, along their length, with different diameters). This may be accomplished by growing the oxide layer 18 at a first voltage, where the pore 16 size attempts to reach a steady state. Then, during the process, a transition zone is created by changing the voltage so that the pores 16 attempt to reach another steady state. More specifically, the steady state diameters of the nano-pore 16 depend, at least in part, on the voltage. For instance, a first voltage may be used to grow the nano-pores 16 initially until a first steady state diameter is reached, and then a second voltage may be used for further growth of the nano-pores 16 until a second steady state diameter is reached. The transition zone of the first and second diameters of the nano-pores 16 occurs between the first and second voltages.

Across a substrate surface S, areas with and without nano-pores 16 may be formed. This may be accomplished using a mask. The mask prohibits pore formation and thus the masked areas include no nano-pores 16. These masked areas of the substrate surface S may be larger in scale (e.g., micrometers or even millimeters) than the size of the individual nano-pores 16 grown in the unmasked areas. Depending upon the mask used, this method can create discontinuous areas (i.e., nano-islands, discussed further hereinbelow) that contain nano-pores 16 or a continuous nano-pore-containing layer that has multiple holes (i.e., areas without nano-pores 16) formed therein. It is also contemplated herein to form nano-pores 16 across the substrate surface S having different dimensions. This may be accomplished, for example, by masking a first area of the surface S, and allowing the nano-pores 16 to grow in the unmasked area while applying a suitable voltage for growth. Thereafter, the area of the substrate surface S including nano-pores 16 grown therein may be masked to preserve the dimensions of those nano-pores 16. The previously masked area of the surface S is now unmasked. A different voltage may be applied to the newly unmasked area to grow nano-pores of another desired size.

Figure 1D:
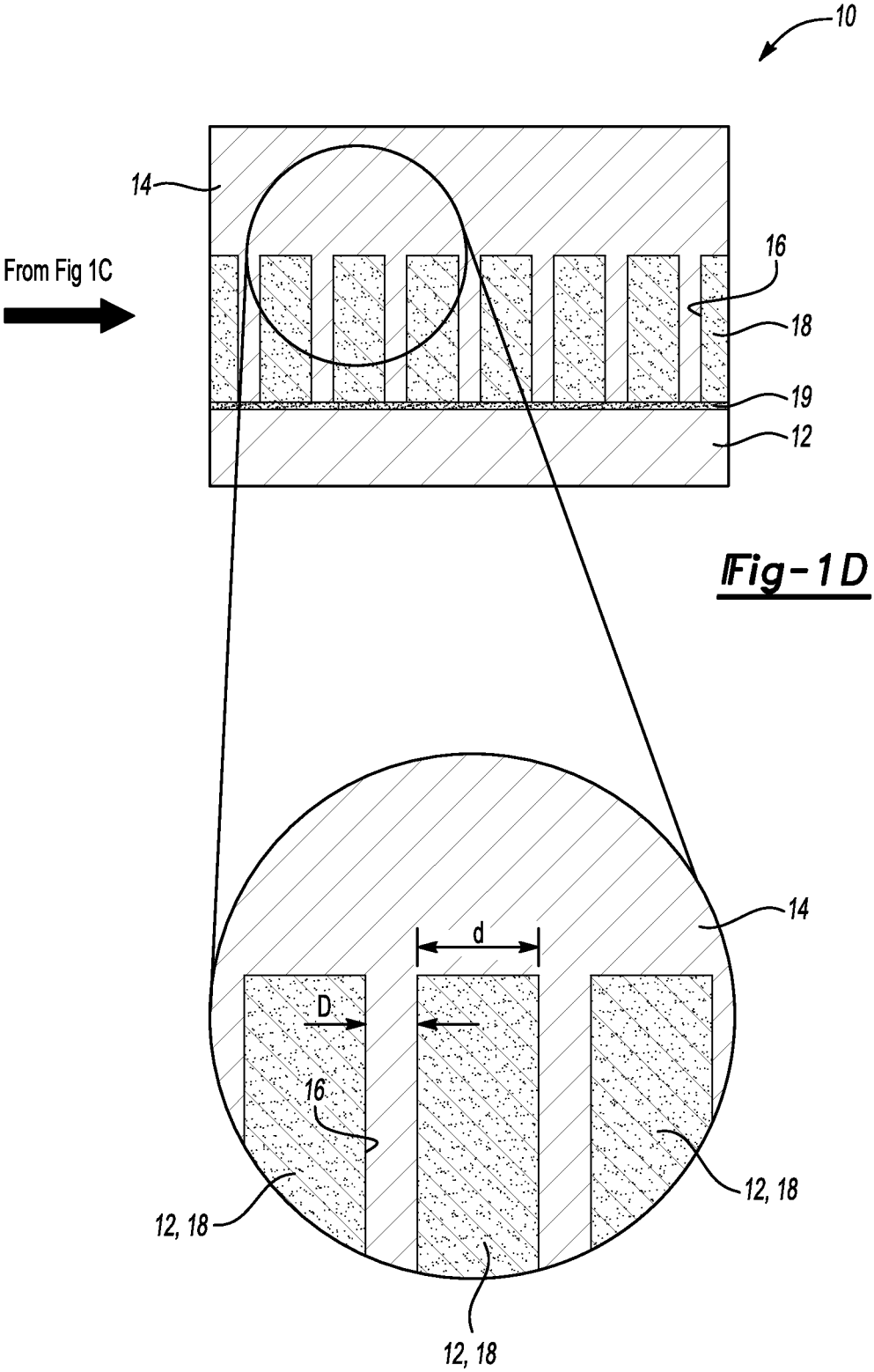
Figure 2A:
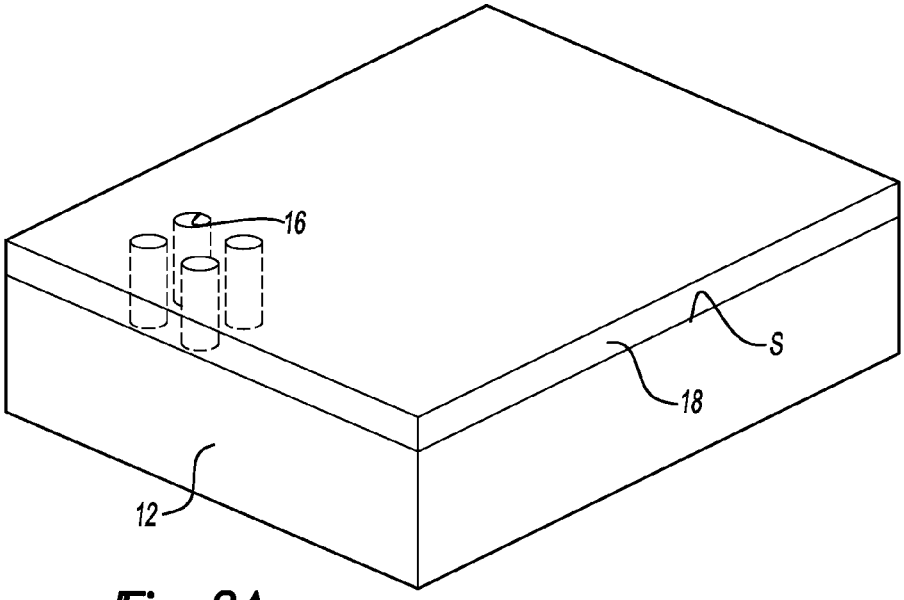
FIG. 2A is a perspective view schematically depicting an example of a substrate including a plurality of nano-pores formed in a surface thereof.
Figure 2B:
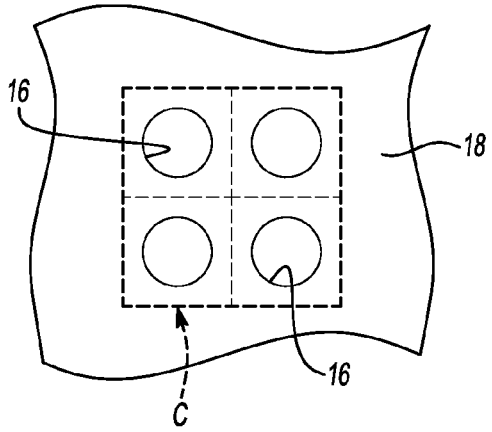
FIG. 2B is a plan view of the plurality of nano-pores shown in FIG. 2A.

In the example shown in FIGS. 2A and 2B, the nano-pores 16 are uniformly situated in the oxide structure 18, where the pores 16 are aligned. In other words, the nano-pores 16 grow normal to the surface during the anodization process described above. The number of nano-pores 16 formed depends, at least in part, on the size (e.g., effective diameter) of each individual pore 16 and the surface area of the substrate surface S that is anodized. As one example, with a 40 V of applied voltage, the number of nano-pores 16 formed ranges from about $1\times10^9$ to about $1\times10^{10}$ across an anodized surface having a surface area of about 1 $cm^2$. In one example, the surface area is as many as tens of squared centimeters. Further, if each pore 16 is defined inside a cell (such as the cell C shown in FIG. 2B), the size of each cell C may range from about 100 nm to about 300 nm. In an example, the spacing d (shown in FIG. 1D-A) between adjacent pores 16 formed in the structure 18 ranges from about 100 nm to about 300 nm. In another example, the spacing d between adjacent pores 16 ranges from about 180 nm to about 220 nm. In still another example, the spacing d between adjacent pores 16 is about 200 nm.

In some cases, it may be desirable to select certain portion (s) of the aluminum substrate 12 to which the magnesium will be bonded, or to select where (on the aluminum substrate 12) to form the nano-pores 16. In these cases, the unselected portions of the substrate surface S are not anodized. This may be accomplished, for instance, by patterning the aluminum substrate 12 prior to growing the oxide structure 18 from it. Patterning may be accomplished via any suitable technique, and is used to perform localized anodization of the aluminum substrate 12. For instance, any standard photolithography method may be utilized, one example of which includes depositing a hard mask material on the aluminum, and then using a photoresist to pattern the mask material to allow localized exposure of the aluminum. In an example, the mask is patterned to expose portion(s) of the aluminum to the electrolyte. The areas that remain exposed once the mask and photoresist are in position may then be subject to local anodization, and the aluminum exposed via the patterned mask is locally anodized, for example, by employing the exposed or patterned aluminum layer as the anode of the electrolytic cell described above.

It is believed that patterning may also be used to alter a stress pattern at certain, perhaps critical, areas of the interface formed between the metal M and the substrate 12 (such as, e.g., those surfaces exposed to wear or rolling contact). For instance, a strong bond may be formed at areas on the substrate surface S where there is a high density of nano-pores 16 that the metal M can interact with during over-casting. Patterning (using a mask as described above) may be used, for instance, to reduce the number of pores 16 at certain areas on the substrate surface S. This may be useful, for example, when it is desirable to transfer stress from the substrate 12 to the over-cast metal M, or visa versa.

It is to be understood that the radius between certain section sizes may also be considered to be areas with increased stress. For these areas, patterning in combination with multiple anodization treatments using different voltages or times may create surfaces with different porous structures. For instance, a surface may be anodized a first time using a constant voltage, and then a portion of the surface is masked. A second anodization treatment may then be applied to the unmasked portion of the surface using a different voltage than was used during the first anodization treatment. After the second anodization is complete, the area of the surface that was unmasked includes nano-pores that vary in diameter along their respective lengths. The nano-pores formed during the first anodization process in the masked area remain unchanged as a result of the second anodization process. As such, the nano-pores in the masked area may include substantially uniform nano-pores that are shorter or longer in length (depending, at least in part, on how the anodization voltage or time was changed during the second anodization treatment) than the nano-pores formed in the non-masked area of the surface.

As briefly mentioned above, patterning may be used to create areas between clusters of nano-pores 16, where each cluster may be referred to as a nano-island. These nano-islands may be useful in instances where the molten metal M cannot sufficiently penetrate the nano-pores 16 (i.e., when no nano-islands are present) which may be due, at least in part, to surface tension. It is believed that the presence of the nano-islands surrounded by denuded areas (i.e., areas without any nano-pores) increases the surface area of the substrate surface S that the molten metal M may suitably penetrate during over-casting. In an example, the porous nano-islands are formed by masking portions of the substrate surface S. The unmasked areas will undergo growth and nano-pore formation, and thus will become the nano-islands. The unmasked portions are anodized to form nano-pores 16 and nano-islands. It is to be understood that the term "nano" when used in conjunction with the porous nano-island refers to the size (i.e., effective diameter) of the individual nano-pores 16 formed in the nano-island. Although it is possible that the surface area of the nano-island may fall within the micrometer range (1 $\mu m^2$ to 1000 $\mu m^2$), the surface area of the nano-island may be as large as desired.

Also as briefly mentioned above, a continuous nano-porous layer may be formed that includes non-porous depressions/holes. This may be formed by masking the designated portions of the substrate surface S that will form the depressions, and exposing the unmasked portions of the surface S to anodization. The areas surrounding the depressions contain nano-pores 16, while the depressions do not contain nano-pores 16. The size of the depressions may also be in the nanometer scale, but may also be as large as desired. Further, the depressions may take any shape or form, such as circles, squares, straight lines, squiggly lines, a flower shape, etc. It is also believed that the presence of the depressions also increases the surface area of the substrate surface S that the metal M may penetrate during over-casting.

Once the aluminum oxide structure 18 has been formed, the magnesium metal (identified by the reference identifier M in FIG. 1C) is bonded to the substrate 12. This may be accomplished, for example, by placing the substrate 12 including the structure 18 grown thereon in a casting die or mold (not shown in the figures), and then over-casting the magnesium metal M onto the substrate surface S. It is believed that the magnesium metal M, which is over-cast while in a molten state, penetrates the nano-pores 16 formed in the oxide structure 18. When nano-islands or depressions are formed, the molten metal M will also penetrate those areas that do not contain nano-pores 16. In some instances, the magnesium metal M flows through the nano-pores 16 (and in some instances non-nano-pore areas), and may contact the underlying substrate 12. The magnesium metal M may contact the underlying substrate 12 so long as the alumina layer 16 is etched to expose the underlying substrate 12. Otherwise, the metal M may contact the barrier layer 19. It is to be understood, however, that a strong bond may form without the metal M flowing all of the way through the pores 16 (e.g., where the metal M forms a metallurgical bond with the underlying substrate 12) so long as the magnesium metal M suitably bonds to the alumina 18. Furthermore, a layer 14 of magnesium metal is formed on the surface of the structure 18 according to the shape of the casting die or mold. The layer 14 in combination with the aluminum substrate 12 makes up the part 10 (shown in FIG. 1D). It is to be understood that the continuity between the magnesium metal M inside the nano-pores 16 and the magnesium layer 14 (shown in FIG. 1D) provides the part 10 with the desired structural integrity. Upon cooling, the magnesium metal M that flowed inside the pores 16 and the magnesium layer 14 (which are integral with each other) are solidified. It is believed that the solidification of the magnesium metal M inside the pores 16 (which is integral with the layer 14 formed on the substrate 12) forms a mechanical interlock with the aluminum oxide structure 18. It is further believed that this mechanical interlock imparts enough strength to the interface between the layer 14 and the substrate 12 that the part 10, as a whole, is structurally sound.

It is to be understood that the oxide structure 18 formed via the anodization process described above may, in some instances, be self-wetting to the bonding metal (such as the magnesium metal M). As used herein, the term "self-wetting" refers to the ability of the metal oxide making up the structure 18 to maintain contact with a liquid disposed thereon (e.g., the molten magnesium metal M). This contact is generally maintained at least in part because of the inter-molecular interactions of the metal and metal oxide when they are brought together. The self-wetting property often depends, at least in part, on the composition of the materials and the temperature. Further, so long as the surface (in this case, the structure 18) is self-wetting, the molten magnesium M may be directly applied to the substrate surface S (i.e., the oxide structure 18 formed thereon).

In instances where the structure 18 is not self-wetting to the metal M, a wetting agent may be introduced into the pores 16 of the structure 18 prior to bonding (e.g., prior to over-casting). The wetting agent may be chosen from any material that will suitably impart wetting characteristics to the surface upon which the metal M is to be applied, and which does not create corrosion or other similar problems upon reacting with the surface. In one example, a metal oxide may be introduced into the nano-pores 16, which reacts with the molten metal M to generate a reaction product that includes a characteristic for wetting the magnesium metal M. Examples of the metal oxide that may be introduced include oxides of manganese, sodium, silicon, tin, cadmium, and zinc. In another example, another metal may be introduced into the nano-pores 16 to impart a wetting characteristic to the metal M. In some cases, the other metal may also contribute to the bonding strength of the mechanical interlock formed during the method. The other metal may be chosen from any metal that is soluble in the molten metal M, some examples of which include manganese, zinc, sodium, silicon, tin, cadmium, molybdenum, and/or alloys thereof. It is believed that iron and/or nickel may also work in certain applications.

The metal oxide or metal used to achieve wetting (as opposed to the molten metal M) may be introduced into the nano-pores 16 using a chemical bath or via chemical vapor deposition, or may be incorporated into the anodization process (such as, e.g., by reversing the voltage applied which may be accomplished by providing an AC voltage that is greater than the DC voltage (in instances where the metal is positively charged), or by utilizing the metal or metal oxide in the electrolyte that is used to form the anodized layer 18). Introducing the metal oxide or metal into the nano-pores 16 may also be accomplished using a coating process.

If structure 18 is self-wetting to the metal M, or the structure 18 has become self-wetting to the metal M, the metal M is applied to the substrate 12 to form the part 10, shown in FIG. 1D. In one example, the metal M is applied via an over-casting process. Over-casting generally involves introducing (via, e.g., pouring) the metal M (e.g., magnesium), in a molten state, over the aluminum substrate 12. As previously mentioned, the molten magnesium penetrates the structure 18 by flowing into the nano-pores 16. In an example, solid magnesium is melted into the molten state by heating the magnesium above its melting temperature. Then, a casting tool 20 (such as a ceramic or metallic crucible or ladle, as shown in FIG. 1C) is utilized to pour the molten magnesium metal M over the substrate 12, which is inside the casting die or mold (not shown). In some cases, the molten metal M may be introduced by placing the substrate 12 in a cavity (e.g., a mold) and then injecting the metal M into the cavity. In yet another example, a counter-gravity, low pressure die casting process may be used where the mold is above a bath of the molten metal M, and the metal M is introduced into the mold via a mechanical pump or by using a gas pressure on the bath to force the metal M up into the mold. The molten magnesium M penetrates into the pores 16 and also forms the layer 14, as previously described. In one example, the over-casting process is considered to be complete when the solidified layer 14 having a desired thickness is formed over the surface of the structure 18.

Referring now to FIG. 1D, the part 10 is formed upon solidifying the metal M to form layer 14 which include the metal in the pores 16 and above the structure 18. In an example, solidification of the metal M includes cooling the metal M. Cooling of the metal M may be accomplished, e.g., via heat loss by natural radiation, convection, and/or conduction. In one example, these methods of heat loss may be accomplished by placing the part 10 at room temperature (e.g., at a temperature ranging from about 20° C. to about 30° C.). In yet another example, the part 10 may be cooled inside the casting die or mold by reducing the temperature of the die or mold. In still another example, the part 10 may be heated to at least 100° C. (or even up to about 300° C.). The temperature at which the part 10 is heated is still lower than the solidification temperature of the metal M, and thus the metal M cools as heat is conducted into the substrate 12 and into the die/mold. The die/mold may be cooled using oil or water that passes through the die.

While the example shown and described in reference to FIGS. 1A-1D includes growing the porous oxide structure 18 on the substrate 12, it is to be understood that other methods may be used to form the oxide structure 18. Examples of other methods of forming the oxide structure 18 include depositing the oxide onto the surface S of the substrate 12 or depositing a metal and then oxidizing it. Suitable deposition techniques include chemical vapor deposition, physical vapor deposition, thermal spraying, and a dipping process. For example, the dipping process may involve dipping the substrate 12 in a molten metal to create a thin metal layer on the surface S, and then oxidizing the thin metal layer. The pores 16 may then be formed in the deposited material, for example, via electro-discharge, a process utilizing a laser, and/or shot blasting. In one example, the pores 16 may then be formed in the oxide (to form the oxide structure 18) via electro-discharge using a suitable electrode. In still another example, electroplating may be used to deposit a material and during the deposition, pores 16 may form. If, for example, electroplating is used as a way of creating a porous surface, the porosity of the surface may be controlled using a patterning and/or masking process (such as lithography), sputtering of non-conductive materials, etc. As one example, a steel substrate is masked, and then electroplating is performed using copper and then nickel. Nickel naturally oxidizes in air, and this process may be accelerated by heating in air. Pores form as a result of the mask and electroplating process, and these pores may be larger in size (e.g., in microns).

It is also to be understood that pores 16 may be formed in other non-oxide materials, such as metals. A metal substrate may be selected and then pores 16 may be formed in the surface using the techniques previously described.

Figure 3:
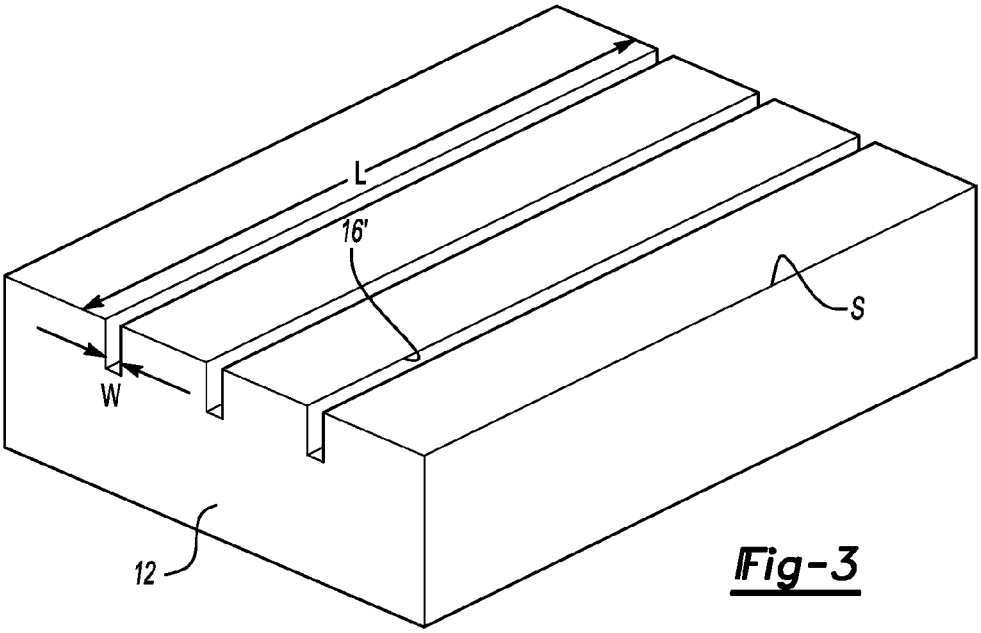
FIG. 3 is a perspective view schematically depicting another example of a substrate including a plurality of nano-crevices formed in a surface thereof.

Another example of the method will now be described in detail below in conjunction with FIGS. 1A-1D and FIG. 3. It is to be understood that any of the substrate materials mentioned above may be used in this example, including, for example, aluminum, steel, titanium, copper, and alloys thereof. It is further to be understood that this process is similar to the process previously described, except that an anodized structure 18 is not formed on the surface S of the substrate 12. In contrast, the instant example of the method involves forming a plurality of nano-crevices 16' directly into the aluminum substrate 12, as shown in FIG. 3. The nano-crevices 16' may be formed via any of deep etching, laser machining, electrodischarge machining, electrochemical machining, or microarc oxidation. After the nano-crevices 16' have been formed, the method further involves bonding a metal M to the substrate 12, e.g., via the over-casting method described above. In this process, however, the molten metal M penetrates the crevices 16' formed in the aluminum surface S, and the part 10 is formed upon solidifying the metal M.

It is to be understood that the instant example of the method may also utilize certain patterning and/or wetting processes as necessary, as also described above.

The nano-crevices 16' may take may different forms, an example of which is a slice having a width W and a length L that extends across the entire substrate surface S as shown in FIG. 3. Other forms of the nano-crevice 16' may include an arbitrary slot, slice, crack, gap, and/or the like that is formed directly into the substrate surface S. Although the crevices 16' shown in FIG. 3 are formed uniformly across the surface S, the crevices 16' may otherwise be formed randomly across the surface S, and in some instances, one or more crevices 16' may intersect each other. Further, the depth of each crevice 16' may vary or may be substantially the same, and the depth may be controlled, at least in part, by the process used to form the nano-crevices 16'. In one example, the nano-crevices 16' have a depth ranging from about 50 nm to about 300 μm. In another example, the nano-crevices 16' may have a depth that ranges from about 10 nm to about 100 μm.

In still another example method, the substrate surface S may be electroplated with a pattern to create gaps and/or paths between the electroplated areas of the surface S. The electroplating may be accomplished, for instance, using an electrochemical cell where the patterned areas of the surface S are the cathode and metal ions are transported to the patterned surface areas. The voltage applied across the cell may be lower than that used for anodizing, such as, e.g., less than about 10 V since the plated surface can conduct electricity better than the oxide (e.g., alumina). During over-casting, the over-cast metal M may fill up the gaps/paths to create a mechanical interlock.

The examples of the method have been described above for forming an automotive part. As previously mentioned, the examples of the method may also be used to form non-automotive parts, such as for aircraft, tools, house components (e.g., pipes), and/or the like.

It is to be understood that the ranges provided herein include the stated range and any value or sub-range within the stated range. For example, a thickness ranging from about 2 μm to about 250 μm should be interpreted to include not only the explicitly recited amount limits of about 2 μm to about 250 μm, but also to include individual amounts, such as 10 μm, 50 μm, 220 μm, etc., and subranges, such as 50 μm to 200 μm, etc. Furthermore, when "about" is utilized to describe a value, this is meant to encompass minor variations (up to +/−20%) from the stated value.

It is further to be understood that, as used herein, the singular forms of the articles "a," "an," and "the" include plural references unless the content clearly indicates otherwise.

While several examples have been described in detail, it will be apparent to those skilled in the art that the disclosed examples may be modified. Therefore, the foregoing description is to be considered non-limiting.

The invention claimed is:

1. A method of bonding a metal to a substrate, comprising:

forming a plurality of nano-features in a surface of the substrate, each nano-feature being chosen from any of a nano-pore or a nano-crevice;

in a molten state, over-casting the metal onto the substrate surface, the metal penetrating the plurality of nano-features; and upon cooling, solidifying the metal inside the plurality of nano-features, the solidification of the metal forming a mechanical interlock between the over-cast metal and the substrate.

2. The method as defined in claim 1 wherein each nano-feature is the nano-pore, and wherein the forming of the plurality of nano-pores is accomplished by growing a structure including the plurality of nano-pores from the substrate surface via anodization.

3. The method as defined in claim 2 wherein the structure is self-wetting to the metal.

4. The method as defined in claim 2 wherein the structure is not self-wetting to the metal, and wherein prior to the over-casting of the metal onto the substrate surface, the method further comprises:

introducing a metal oxide into the plurality of nano-pores; and reacting the metal oxide with the metal to generate a reaction product including a characteristic for wetting the metal.

5. The method as defined in claim 4 wherein the metal oxide is chosen from oxides of manganese, sodium, silicon, tin, cadmium, zinc, nickel, and iron.

6. The method as defined in claim 2 wherein the structure is not self-wetting to the metal, and wherein prior to the over-casting of the metal onto the substrate surface, the method further comprises introducing an other metal into the plurality of nano-pores.

7. The method as defined in claim 1 wherein the forming of the plurality of nano-features is accomplished via any of deep etching, laser machining, electrodischarge machining, electrochemical machining, or microarc oxidation.

8. The method as defined in claim 1 wherein when the metal is magnesium, the substrate is selected from the group consisting of aluminum, magnesium, zinc, titanium, copper, steel, and alloys thereof.

9. The method as defined in claim 1 wherein when the metal is aluminum, the substrate is selected from the group consisting of aluminum, zinc, magnesium, titanium, copper, steel, and alloys thereof.

10. The method as defined in claim 1 wherein prior to forming the plurality of nano-features, the method further comprises patterning the substrate surface.

11. A method of creating an aluminum-to-magnesium bond, comprising:

growing an oxide layer from an aluminum surface, the oxide layer including a plurality of nano-pores defined therein;

over-casting magnesium onto the aluminum surface, the over-casting including introducing molten magnesium onto the oxide layer so that molten magnesium penetrates the plurality of nano-pores; and solidifying the molten magnesium to form a mechanical interlock between the solidified magnesium and the aluminum surface.

12. The method as defined in claim 11 wherein the growing of the oxide layer is accomplished by anodizing the aluminum surface in the presence of an electrolyte.

13. The method as defined in claim 11 wherein the solidifying is accomplished by cooling the molten magnesium.

* * * * *